United States Patent [19]

Postma et al.

[11] 3,939,657

[45] Feb. 24, 1976

[54] MULTIPLE REGENERATORS

[75] Inventors: Norman D. Postma, Northville; David W. Barton, Birmingham, both of Mich.

[73] Assignee: Ford Motor Company, Dearborn, Mich.

[22] Filed: Sept. 5, 1974

[21] Appl. No.: 503,588

[52] U.S. Cl. ..... 60/526

[51] Int. Cl.[2] ..... F02G 1/04

[58] Field of Search ..... 60/517, 524, 526

[56] References Cited

UNITED STATES PATENTS 3,854,290 12/1974 Asselman ..... 60/524

*Primary Examiner*—Allen M. Ostrager

*Attorney, Agent, or Firm*—Joseph W. Malleck; Keith L. Zerschling

[57] ABSTRACT

A hot gas engine of the Stirling type is disclosed. The engine has a heater head assembly provided with a plurality of separated regenerators connected in series in the heater tube labyrinth. The regenerators may be cascaded in size and mass to meet predetermined heat exchange design conditions. The temperature of exhaust gases exiting directly from the heater head assembly can be optimized at less than 800°F, but more practically at about 1,000°–1,200°F.

8 Claims, 12 Drawing Figures

MULTIPLE REGENERATORS

BACKGROUND OF THE INVENTION

Thermal efficiency and weight are two of the primary concerns in the development of the Stirling engine. A Stirling engine is generally recognized as a hot gas engine of the type where pressurized gas is reciprocally displaced in a closed system between two spaces or chambers, one a hot chamber in which expansion may take place, the other a cold chamber in which compression may take place. Displacement of the closed gas (working gas) results in a temperature change generally at constant volume; expansion or compression takes place substantially at a uniform temperature. It is an engine which has two power strokes per piston and has an operation highly dependent upon the input of heat to the closed gas adjacent the high temperature chamber, typically on one side of a heat accumulator (regenerator) in the closed system.

Prior art constructions to date have utilized heater head assemblies whereby combusted gases or flue gases (typically in the range of 2,300°–3,500°F) are passed along a heat source system and about a heat transfer tube containing the closed gas and interconnecting the spaces. The mass flow of the heat source system varies considerably between idle and high speed operation of the engine. The amount of heat transferred to and through the walls of the tube and eventually to the closed gas (working gas) results in a reduction in the temperature of the combusted gases; the temperature typically is lowered to the range of 1,350°–1,800°F. Obviously a large amount of thermal energy remains within the heated medium (flue gas) after having passed about the heat transfer tube arrangement. To eliminate wasting the heat content, the prior art has turned to the use of a rotating regenerative wheel, usually of the ceramic type, which at one zone receives heat from the combustion gases and at another zone releases heat to the inducted air for preheating. The exhaust gases, after having passed through the wheel to give up considerable latent heat content, is usually in the temperature range of 650°F. By the time the exhaust gases are finally released to atmosphere, they have assumed a temperature as low as 200°–250°F.

Unfortunately, the cost and weight added by the use of the regenerative wheel to utilize the latent heat of the spent gases is a problem. Many heater tube arrangements have been attempted by the prior art to overcome the basic problem.

One approach has been to increase the heat transfer capabilities by the use of finned tubing; smooth surfaces of the tubing is augmented by the use of flat fins which extend outwardly in a radiating direction of the center line of the tubing. Unfortunately, this presents a nesting problem for the tubing as well as a problem in the fabricating of the heater head assembly. One limitation on any solution will be location of the spaces. In a modern 4 piston Stirling engine the spaces are 90° apart about the axis of the engine; the gases must be moved between these 2 spaces with efficiency and maximum heat exchange. To meet this limitation, a typical approach is to use a hair-pin bent tubing configuration between the high temperature space and the heat accumulator (regenerator); one leg of the configuration is shorter and generally parallel to the engine axis, the outer leg spirals about to meet the 90° indexing and typically has auxiliary finned transfer surfaces.

SUMMARY OF THE INVENTION

The primary object of this invention is to provide a hot gas engine of the Stirling type which has an improved heater head assembly effective to more efficiently exchange a greater heat content directly between a heat source and a closed gas system.

Another object of this invention is to provide a heater head assembly of the above type which is capable of both eliminating the need for augmented outer heat exchange surfaces (such as fins), but also is capable of increasing the thermal exchange between the heat source and closed gas system while reducing the cost of fabrication.

Yet still another object of this invention is to provide an apparatus for transferring heat between a closed gas system and a heat source which reduces resistance to mass flow through the heat source system while allowing the operating temperature of said heat source system to perform at a slightly higher overall average temperature but with a more efficient drop in temperature at the transfer zone.

Yet still other objects of this invention comprise (a) effect a reduction in the raw exhaust gas temperature while providing for reduced size or optimally the elimination of the preheater in the external combustion circuit, (b) effect a reduction of the maximum temperature of the heater head assembly, while lowering both fuel input requirements and losses due to cooling and exhaust rejection, all at an equivalent power output level, and (c) permit the use of thinner or more economical tubing material in the heater tube assembly.

A more specific object of this invention is to provide a hot gas engine having a closed gas system with at least one high temperature space and at least one low temperature space, a high pressure gas in the spaces and means, such as a heater tube, for reciprocally displacing said high pressurized gas between said spaces, the apparatus being characterized by said means having a plurality of heat accumulators (regenerators) connected in series and having at least that portion of the heater tube disposed upstream from the last of said heat accumulators exposed to the heat source of the engine for increasing the effectiveness of heat transfer from said heat source to the closed gas system.

Specific features pursuant to the above objects is the use of at least two heat accumulators (regenerators) disposed in a series along a common heater tube, the regenerators being dimensioned with differential masses and cascaded; the portion of the common tubing extending between the series of connected regenerators is directed so that it re-enters the zone of exposure to the heat source; the temperature of the heat source system and mass flow thereof is programmed so that spent exhaust gases exiting from the heater tube arrangement will be at a temperature level less than 1200°F and optimized at less than 800°F.

DETAILED SPECIFICATION

If we look closely at a Stirling type engine system, we fine that the limitation on efficiency or speed of the engine is due mainly to the form of the heater tube assembly. In spite of the large difference in temperature between the flue gases (heat source or heated medium) and the heater tubes, the heat transfer from the flue gases to the tube and through the tube wall is relatively poor. A rather large tube surface area is seemingly required; however, large tubes (large surface area) give optimum heat transfer from the outside but do not give an optimum heat transfer on the inside. In order to improve the heat transfer of the flue gases, the heater tubes of the prior art have been made typically in the form of an array or cage of tubes to which fins are brazed at remote sections of the tubes. However, this only increases the outer surface area and does little to match the heat input of the outer surface to the heat extraction at the inner surface of the tubes.

Figure 1:
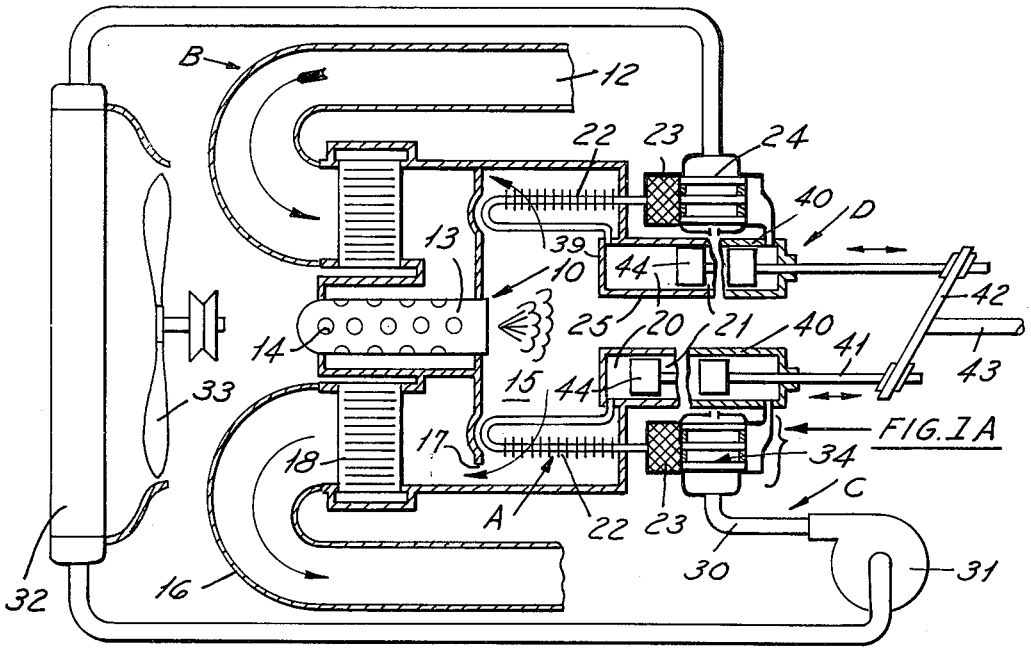
FIG. 1 is a schematic illustration of a hot gas engine of the Stirling type typically representing a prior art heater head assembly.

To gain a greater understanding of the way prior art heater head assemblies have operated, we turn to FIG. 1. Here the hot gas engine of the Stirling type is essentially comprised of four major assemblies: a closed high pressure gas system A, a heat source circuit B, a cooling circuit C and an operative drive assembly D. The closed high pressure working gas system A comprises two spaces, a high temperature space 20 and a low temperature space 21, the spaces being interconnected by a passage means which in part comprises the heater tubes 22, accumulator or regenerator 23 and cooling tubes 24 disposed on the opposite side of the accumulator. In a double-acting piston arrangement, as shown here, the low temperature space will be located in a different piston chamber 40 from the piston chamber 39 which contains the high temperature space 20. This eliminates the need for separate displacer pistons since the working piston can then function to cause displacement.

The heat source circuit B is arranged so that a heat exchange zone at location 15 receives the heater tubes 22 for exposure to the heated surrounding medium. The heat source circuit B particularly comprises an induction passage 12 into which ambient air (sometimes mixed with exhaust gas recirculation) is forced by a fan or centrifugal blower, not shown. The inducted air is directed to a combustion chamber 13 through openings 14 in the cylindrical wall of the chamber. Fuel is added to the chamber 13 via atomizing nozzle 40 and ignited therein for providing a flaming combustion, the products of which flow or migrate through location 15. The products of combustion (exhaust gases) pass through an opening 17 into the exhaust passage 16 for withdrawal from the engine. Many prior art applications utilize a heat re-cycling wheel 18 or preheater which has at least one half or sector thereof exposed to the withdrawn exhaust gases, the wheel then rotating to expose the heated half or sector to the incoming ambient air and thereby preheat said air.

The cooling circuit C comprises a passage means 30 containing the cooling medium, the medium being forced along said circuit by a pump 31. A radiator section 34 surrounds the cooler tubes 24 for extracting heat from the tubes 24; a radiator 32 is disposed for releasing heat to the atmosphere and a fan 33 is employed to move air thereacross.

The operative drive assembly D has a working piston 44 subject to the forces imposed; connecting rods 41 attached to the working pistons move a swash plate 42 in a synchronous manner responsive to the movement of the working pistons. A driven element 43 connected to the swash plate provides the automotive vehicle power to the transmission and driveline.

Figure 2:
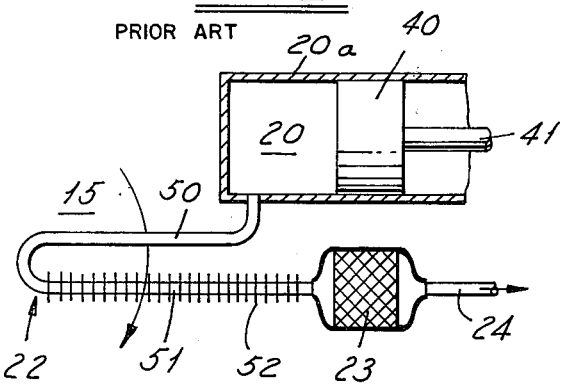
FIG. 2 PRIOR ART
FIG. 2 is an enlarged portion of the schematic of FIG. 1 illustrating solely the high temperature space and that portion of a common heater tube arrangement having a heat accumulator disposed therein.

In FIG. 2, the heater head assembly, with which this invention is particularly concerned, shows again the high temperature space 20 associated with the heater tubes 22. The tubes extend through the heat exchange zone 15. The heater tubes are typically given a hair-pin turn configuration whereby a first leg or portion 50 of the heater tube is subject to a higher degree of heat. A second leg or portion 51 of the heater tube is exposed generally to a slightly lower temperature area of the heated medium and therefore typically has a plurality of fins 52 radiating from the axis of the tube. The heat accumulator or regenerator 23 separates the heater tubes from the cooling tubes 24 and acts as an efficient mechanism whereby the high temperature and low temperature spaces may be isolated by giving up and restoring heat to the regenerator as the gas passes reciprocally therethrough.

If one were to view the prior art Stirling engines from an operative or method standpoint, the thermodynamic cycle of the engine could consist essentially and idealistically of two isothermal and two constant volume processes (adiabatic). An engine capable of operating on this cycle might consist of elements as shown in FIG. 1 whereby a cylinder 25 containing power piston 44 defines a space therebetween as the working space 21 or low temperature space; such space is further delimited by the regenerator 23. On the other side of the regenerator 23, between the cylinder 25 and the power piston 44, is the expansion space 20 or high temperature area. The expansion or high temperature space is maintained at an elevated temperature in the range of 1,450°F and the low temperature space is maintained in a temperature range of 170°F. The differential between the high and low temperature spaces produces a net work force.

The typical movements of the double-acting Stirling type engine is described in an article entitled "Prospects of the Stirling Engine for Vehicular Propulsion," published in Philips Technical Review, Vol. 31, No. 5/6, pages 168–185, (1970); the article is incorporated herein by reference.

An undue flow resistance at a certain point within the closed gas system can alter the relative velocities throughout the entire system. To avoid this and yet increase the internal surface area of the heater tube assembly, the invention herein comprises the elongation of a common heater tube path but with the insertion of a plurality of heat accumulators or regenerators.

Figure 3:
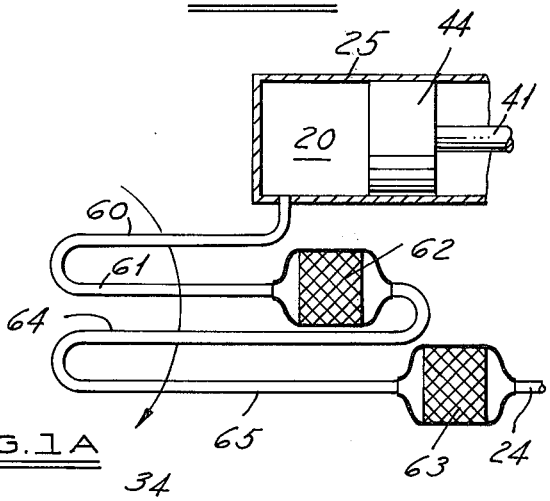
FIG. 3 is a fragmentary schematic illustration similar to that of FIG. 2 but representing one of the modes of this invention.
Figure 1A:
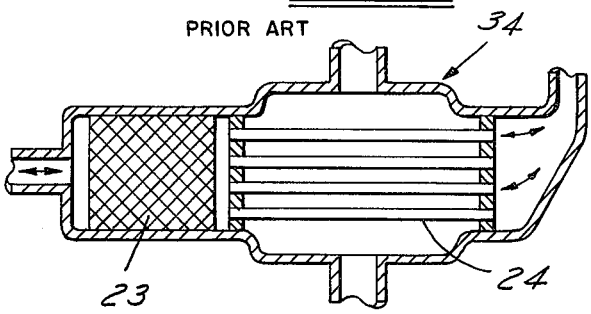
FIG. 1A PRIOR ART
FIG. 1A is an enlarged view of element 34 of FIG. 1.

In FIG. 3, the high temperature space 20 is defined by wall 25 of the cylinder and power piston 44. The heater tube means comprises a first hair-pin turn passage configuration, in advance or upstream from the first heat accumulator 62; the hair-pin turn configuration is exposed to the heat zone location 15. Both legs 60 and 61 of the first hair-pin turn configuration are subject to a relatively high temperature within the location 15. A second hair-pin turn configuration interconnects the heat accumulators 62 and 63 and is directed to return back into the heat location 15; the second configuration may have a greater length with the two legs 64 and 65 being longer and devoid of any fins. The total internal surface of such extended and lengthened heater tube means is better matched to the exterior surface exposed to the heating medium and is superior to a system where external fins are used to increase the external surface and do nothing to augment the internal surface. As the number of regenerators is increased, the tubes in that portion of the passage means, which is more remote from the center of the heat source, can be made of less costly materials than the tubes in the more immediate area.

A modification of the preferred embodiment of FIG. 3 might be made so that there need be no consideration as to the transfer of heat on the outside, but only consideration as to the total surface area of the interior of the tubes. This becomes possible by the use of indirect heating in the form of heat pipes. Large amounts of heat can be transferred from a large surface to the outer surfaces of the tube. Thus a cycle can be set up in which sodium will move successively through vapor and the liquid phases and become a transformer of the heat flux density. A practical embodiment of this could comprise a convoluted heating chamber whereby the flue gas is flowed through the convoluted lining and the sodium on the opposite side of the lining is heated and vaporized to migrate to the heater tubes whereby the sodium condenses thereon. The liquid thus formed will flow back again to the convoluted chamber under the influence of capillary forces. Since the heat transfer by means of the condensation of sodium can be considered infinitely great in comparison with heat conduction through the walls of the tube and the transfer of heat from the walls to the gas inside, the Stirling engine could be optimized for a constant temperature of the outside wall of the heater tubes of FIG. 3.

Figure 4:
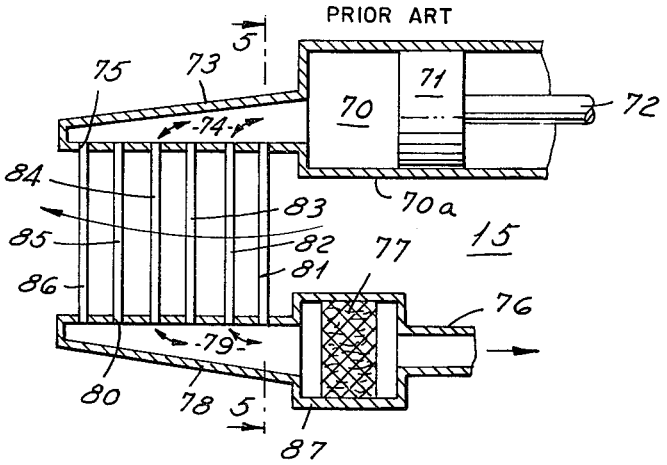
FIG. 4 PRIOR ART
FIG. 4 is a fragmentary schematic illustration similar to FIG. 2, but representing another prior art mode.
Figure 5:
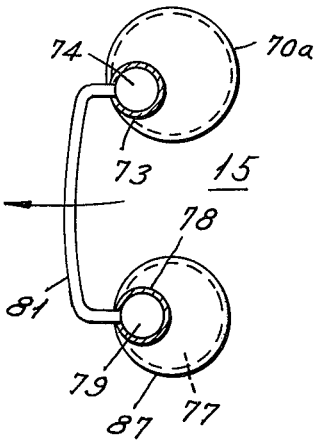
FIG. 5 PRIOR ART
FIG. 5 is an end view of the schematic structure of FIG. 4.

Some popular commercial Stirling engines are of the type which utilize manifolds which extend upwardly from the high and low temperature spaces. Such a prior art construction is shown in FIGS. 4 and 5 with the manifolds 73 and 78 oriented horizontally for purposes of illustration. Here the high temperature space 70 is defined between the wall 70a and the piston 71; the space has a chimney-like manifold 73 defining an elongated space 74. A similar chimney-like manifold 78 is independently spaced therefrom; manifold 78 defines an elongated space 79 which is in communication with a regenerator or heat accumulator 77 separating the cold space (connected by way of tube 76). The passage means interconnecting the manifolds to complete the heater head assembly comprises a series of small diameter tubes 81, 82, 83, 84, 85 and 86. Each have one end connected to an opening 75 in the manifold 73 and an opposite end connected to an opening 80 in the manifold 78. Combustion gases in zone 15 pass each of the heater tubes once for purposes of heat exchange.

Figure 6:
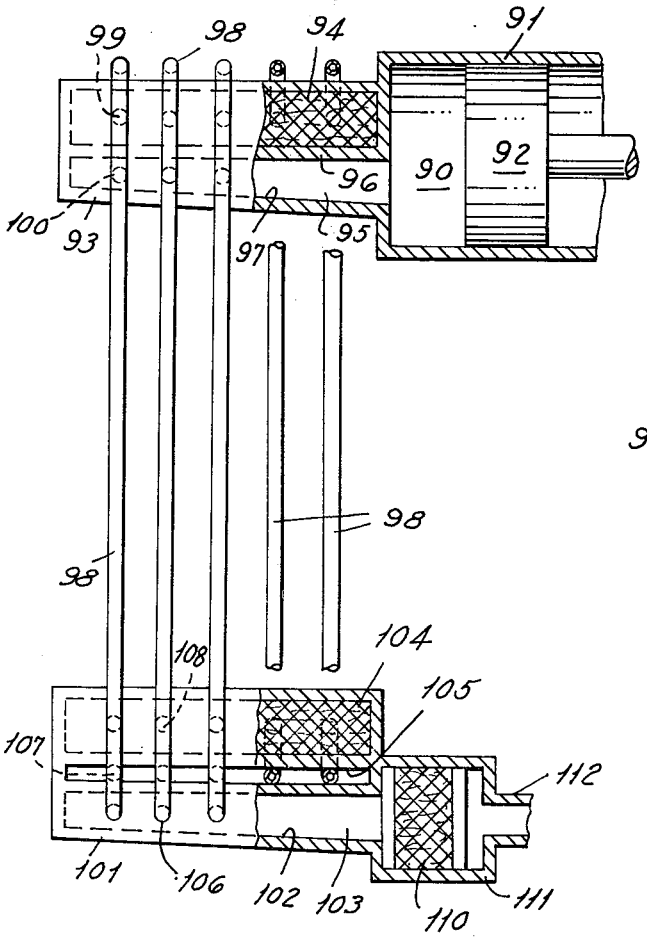
FIG. 6 is an enlarged view similar to that of FIG. 4 but illustrating the inventive mode as applied to this prior art construction.
Figure 7:
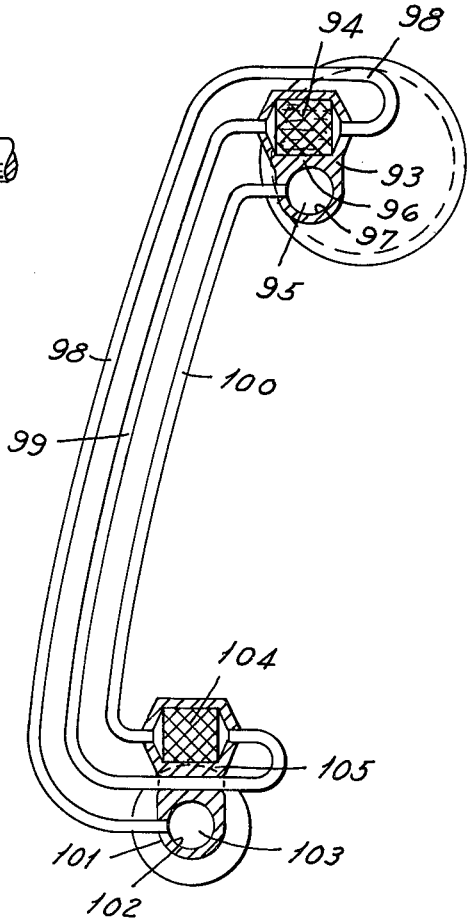
FIG. 7 is a side view of the schematic structure shown in FIG. 6.

In accordance with the invention herein, a plurality of heat accumulators are incorporated into the closed gas system as shown in FIGS. 6 and 7. Here, manifold 93 extends from the high temperature space 90 defined by wall 91 and piston 92; the manifold has a heat accumulating section 94 and a non-accumulator section 95 separated by a wall 96. The interior wall 97, defining the space 95, has a chimney-like configuration and is in communication with space 90. A similarly defined manifold 101 extends from the low temperature space (not shown). Manifold 101 has a heat accumulating section 104 and a non-accumulator section 103 which again has an interior wall 102 defining space 103 defining a chimney-like space in communication with a third heat accumulator 110 in body 111; body 111 connects by way of passage 112 to the low temperature space.

All of the heater tubes spanning between the manifolds, at least those portions upstream of the last regenerator 110, are exposed to the heat source. A first array or series of tubes 100 connect non-accumulator section 95 with the accumulator section 104 of manifold 101 (see FIG. 7). The high pressure gas then passes into heater tubes 99 in a reverse direction by making a hair-pin turn; tubes 99 make an array lying in a plane generally aligned with the plane of tube 100. The pressurized gas is then passed through accumulator 94 to enter an array or assembly of tubes 98 which connect with the non-accumulator section 103 of manifold 101. The combusted gases (heat source) virtually see or pass the closed working gas flow at least three times. The number of regenerative sections can be increased from that shown in FIGS. 6 and 7.

Figure 8:
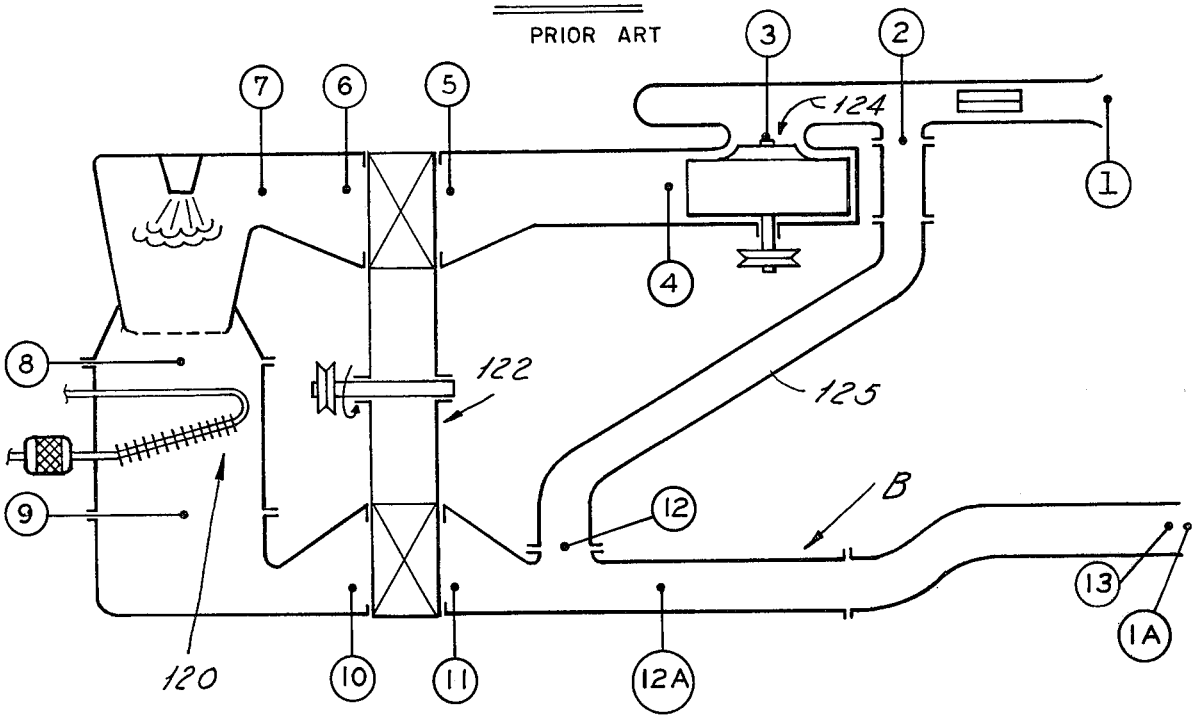
FIG. 8 PRIOR ART
FIG. 8 is a schematic diagram for a typical heat source flow system of the prior art.
Figure 9:
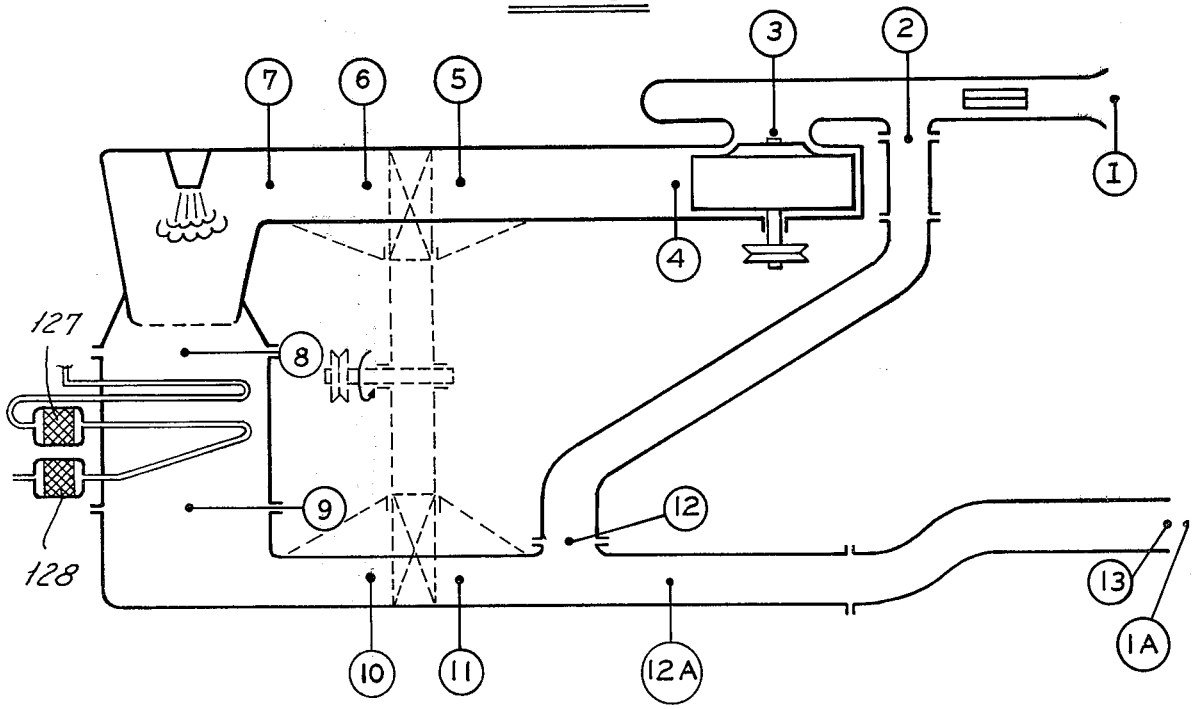
FIG. 9 is a schematic view similar to that of FIG. 8 but representing the heat source flow system as modified according to this invention.

The benefits derived from the use of the constructions shown in the preferred and alternative embodiments, is illustrated in Table I which compares various temperatures of the heat source circuit as shown in FIGS. 8 and 9. In FIG. 8, a heat source circuit B is shown for a typical prior art construction utilizing a conventional heater tube assembly 120 interposed in the heat circuit and having a regenerative wheel 122 for preserving the heat and preheating the incoming air 124. Exhaust gas recirculation through passage 125 is shown as part of the system since this would be typical for a commercial arrangement. Table I first compares estimated data for a Stirling engine that is operated at 4,000 r.p.m. (full load) having a test ambient temperature selected to be at about 100°F and exhaust gas recirculation selected to be around 25% of the exhaust gas flow. Temperatures, mass flow ($m$) and pressure were projected at stations 1 through 13. It should be noted that the temperature exiting from the heater tubes is around 1,880°F for the prior art; a considerable portion of this heat is extracted by the regenerative wheel 122 so that the gas is reduced in temperature to approximately 640°F. By the time the exhaust gases pass through the remainder of the tubing system, the temperature is reduced to approximately 260°F at exit point 13 for a single exhaust pipe or also at 1A for dual exhaust pipes.

In direct contrast, Table II shows projected temperatures under the conditions of Table I for two constructions embodying the principles of this invention, one with the preheater 122*a* modified (made smaller) and one with the preheater eliminated. For the construction with a modified preheater, the temperature at station 9 is reduced to 1,540°F and eventually has a release temperature of 250°F. The task of energy transfer is reduced considerably as well as the temperatures. This suggests lower preheater stress, lower preheater cost and lower pressures in the blower circuit.

For the construction with the preheater eliminated, the temperature at point 9 is reduced to 720°F and eventually has a release exhaust temperature of 280°F at 13. This dramatic difference is due to the higher efficiency of heat transfer which takes place with the series regenerator system and extended passage system of this invention without the use of finned tubing. Series regenerators 127 and 128 are employed.

It should be pointed out that the lower temperature of 2,030°F at station 11, for the construction without a preheater, causes the heat transfer rate through the heater tube walls to be reduced as a result of a lower thermal head. The engine may operate slower to maintain heat balance. The overall powerplant energy balance requires that the net power of the engine (Q power) be the difference between the energy of the fuel input (Q fuel) and the various losses. The losses can be grouped into: (a) exhaust plus miscellaneous radiation losses (Q exhaust), (b) heat rejected by the cooling system to the air (Q cool), and (c) power consumed by auxiliaries (Q aux.) such as the cooling fan, water pump, or combustion blower. One of the goals of this invention is to affect a reduction in the raw exhaust gas temperature, such as at stations 9 and 10. Total success in this endeavor would lead to elimination of the preheater wheel. However, if elimination of the preheater causes a slower operating powerplant, then this invention may best be used to reduce the size of the preheater, reduce preheater stress and cost, the speed of recovering heat. More importantly, exhaust losses would be lower, auxiliary losses would be lower since the air pumping energy is reduced, and certainly cooling losses can be lowered since less energy of the cooling gas is rejected to the cooling water while keeping the cold side temperature reasonably low.

Design tradeoffs are facilitated by this invention. Tradeoffs can be made to affect fuel input top operating temperatures, and cost for the same net power output. By improving the heat transfer rate in the heater head and utilizing this invention, the top operating temperature of the heater head can be lowered or fuel input can be adjusted.

Figure 10:
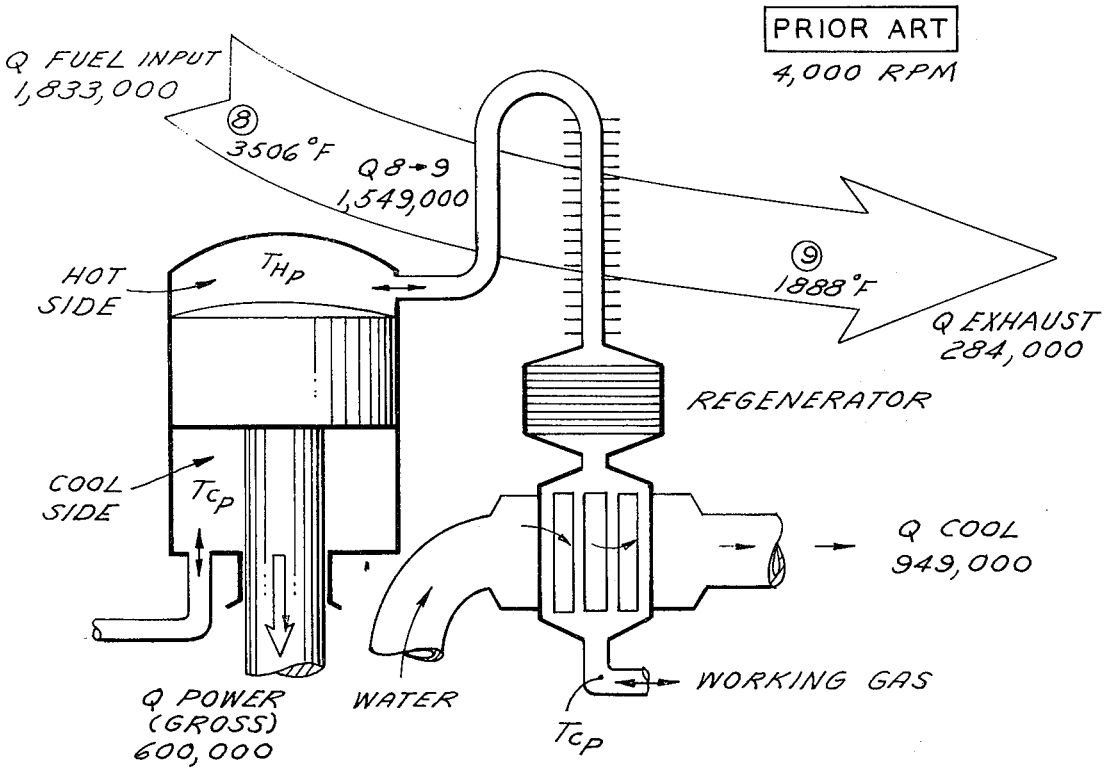
FIGS. 10 and 11 are respective schematic illustrations of energy balances in a prior art Stirling engine and an engine in conformity with this invention.
Figure 11:
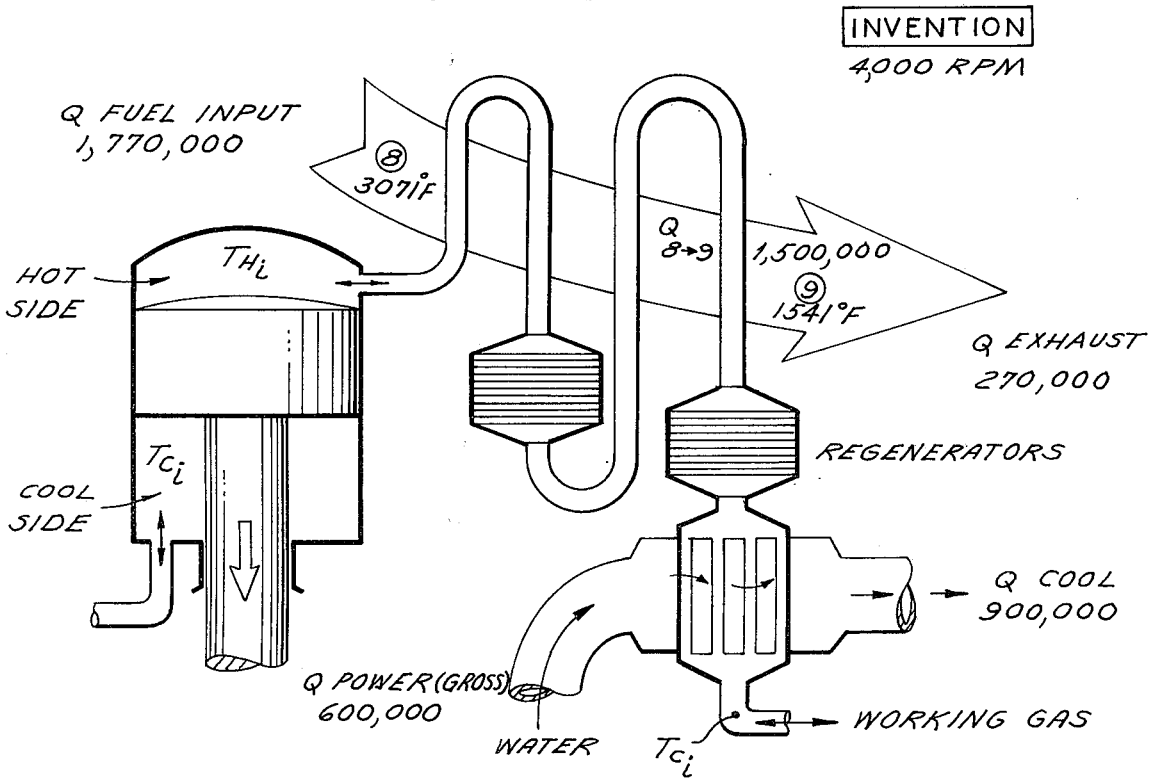

The data of Table I illustrates that another goal of this invention has been met. This can be best explained by comparing FIGS. 10 and 11. The maximum operating temperature in the heater head assembly is reduced thereby reducing the creep limitation on the tubing material and thereby permitting either higher operating pressures in the closed system or less expensive materials and/or thicknesses for the heater tubes. The net power output remains essentially the same for the inventive mode (FIG. 11) in comparison with the prior art (FIG. 10). In these figures, the several energy levels are schematically represented. The gross power energy taken from the engine is generally equal to the fuel input energy less the loss in energy due to cooling and rejected in the exhaust.

$$Q\ \text{power gross} = Q\ \text{fuel input} - [Q\ \text{exhaust} + Q\ \text{cool}]$$

With equivalent power outputs, the energy losses due to cooling and exhaust rejection are less and the energy of fuel input can be less. The maximum heater head temperature is lower by about 450°F; yet the energy transferred to the closed gas system (between stations 8 and 9) is roughly the same.

The heat source circuit and the temperature therein is dependent somewhat on mass flow; similarly, the pressure therein will vary depending upon the speed of operation. Therefore, Table II illustrates, only for the prior art construction, the variation in mass flow and differences in temperature as a result of operating the engine at part speed (30 m.p.h.) and at idle conditions.

Table I

| Location | 4000 r.p.m. (Prior Art) | | | 4000 r.p.m. (Invention with Preheater Modified) | | | 4000 r.p.m. (Invention with Preheater Eliminated) | | |
|---|---|---|---|---|---|---|---|---|---|
| | $\dot{m}$ LB/HR | t°F | p-psi | $\dot{m}$ LB/HR | t°F | p-psi | $\dot{m}$ | t | p |
| 1 | 1830 | 100 | 14 | 1830 | 100 | 14 | 1830 | 100 | 14 |
| 2 | 470 | 640 | 14 | 470 | 620 | 13 | 470 | 720 | 14 |
| 3 | 2300 | 220 | 14 | 2300 | 220 | 13 | 2300 | 220 | 14 |
| 4 | 2300 | 270 | 17 | 2300 | 260 | 17 | 2300 | 280 | 17 |
| 5 | 2300 | 270 | 17 | 2300 | 260 | 16 | | | |
| 6 | 2300 | 1620 | 16 | 2300 | 1260 | 16 | | | |
| 7 | 2300 | 1620 | 16 | 2300 | 1260 | 16 | 2400 | 280 | 16 |
| 8 | 2400 | 3500 | 15 | 2370 | 3070 | 15 | 2500 | 3470 | 16 |
| 9 | 2400 | 1880 | 15 | 2370 | 1540 | 15 | 2500 | 720 | 16 |
| 10 | 2400 | 1880 | 15 | 2370 | 1540 | 15 | | | |
| 11 | 2400 | 640 | 14 | 2370 | 620 | 14 | 2030 | 720 | 14 |
| 12 | 470 | 640 | 14 | 470 | 620 | 14 | 470 | 720 | 14 |
| 13 | 1930 | 260 | 14 | 1900 | 250 | 14 | 1930 | 280 | 14 |

Table II

| Location | 1131 r.p.m. (30 m.p.h.) | | | 600 r.p.m. (Idle) | | |
|---|---|---|---|---|---|---|
| | $\dot{m}$ | t | p | $\dot{m}$ | t | p |
| 1 | 140 | 100 | 14 | 80 | 100 | 14 |
| 2 | 150 | 320 | 14 | 110 | 330 | 14 |
| 3 | 290 | 220 | 14 | 200 | 240 | 14 |
| 4 | 290 | 220 | 14 | 200 | 240 | 14 |
| 5 | 290 | 220 | 14 | 200 | 240 | 14 |
| 6 | 290 | 1380 | 14 | 200 | 1380 | 14 |
| 7 | 290 | 1380 | 14 | 200 | 1380 | 14 |
| 8 | 300 | 2700 | 14 | 200 | 2370 | 14 |
| 9 | 300 | 1380 | 14 | 200 | 1380 | 14 |
| 10 | 300 | 1380 | 14 | 200 | 1380 | 14 |
| 11 | 300 | 320 | 14 | 200 | 330 | 14 |
| 12 | 150 | 320 | 14 | 110 | 330 | 14 |
| 13 | 150 | 220 | 14 | 90 | 240 | 14 |

We claim as our invention:

1. In a hot gas engine having at least one high temperature space and at least one low temperature space, a high pressure gas in said spaces, and means for reciprocally displacing said high pressurized gas between said spaces, apparatus for transferring heat to said high pressure gas and for isolating the heat content thereof to one zone of displacement of said gas, comprising:

a. heat source means effective to generate a heated medium within a first location, and b. means defining heat conductive passages interconnecting said spaces and through which said high pressurized gas passes for displacement, said passage means having at least first and second heat accumulators disposed in a series therein with portions of said passages which are particularly disposed between said accumulators and portions which are disposed in advance of the first accumulator, said portions being directed through said first location for exposure to said heated medium.

2. The apparatus as in claim 1, in which said passage means is defined by thin walled metallic tubing, the tubing being nested to extend substantially transverse to movement of said heated medium therepast, said tubing having a smooth cylindrical configuration devoid of heat transfer fins.

3. The apparatus as in claim 1, in which said spaces are each further comprised of an elongated manifold extending therefrom, each manifold containing a heat accumulator section having one of said heat accumulator of said passage means therein and a non-accumulator section, said portions of said passage means being comprised of a plurality of independent tubes extending between spaced locations of each said manifold, each tube having one end connected to said accumulator section and an opposite end connected to a non-accumulator section.

4. The apparatus as in claim 3, in which each manifold contains more than one heat accumulating section.

5. The apparatus as in claim 1, in which said heat accumulator is comprised of a network of fine metallic strands having a diameter of about 0.05 millimeters, said wire being intimately crushed together into a nest to substantially occupy the space entrained by the wall of said accumulator.

6. The apparatus as in claim 1, in which said high pressure gas experiences compression in the low temperature space at a generally uniform low temperature, said gas is displaced from the low temperature space to the high temperature space through said passage means at constant volume while undergoing an increase in temperature as a result of heat returned to said gas from said heat accumulator, said gas undergoes expansion in the high temperature space while at a generally uniform temperature, and said gas is displaced back through said passage means rejecting substantial portions of the heat content to the accumulator for reentry to the low temperature space.

7. A method of operating a hot gas engine of the Stirling type having a working element, the steps comprising:

a. providing at least one high temperature space and at least one low temperature space interconnected by a closed passage means having at least first and second and third separated heat accumulators, said passage means and spaces defining a closed high pressure system within which is contained hydrogen, providing a constant heat source, b. compressing said closed gas within the low temperature space while at a temperature in the range of c. exposing portions of said passage means in advance of said third heat accumulator to said constant heat source, d. displacing said compressed gas while at generally constant volume from said low temperature space to said high temperature space, said compressed gas being passed through each of said heat accumulators, e. expanding said gas in said high temperature space at an elevated temperature of about 1,450°F for driving said working element of the engine, and f. displacing said expanded gas back through said passage means at generally constant volume while releasing heat content to said accumulators.

8. The method as in claim 7, in which said constant heat source comprises a flow system in which a blower inducts ambient air into said system and moved along a circuit, said system having a zone into which a combustible mixture is introduced for providing flaming combustion, said system releasing the products of said flaming combustion partly to atmosphere and a part thereof is returned to the intake of said blower, the method being characterized by location said exposed passage portions in said system immediately downstream of said combustion zone, the mass flow of said system in or adjacent the zone at which said exposed passage portions extend thereinto ranges from 300 to 3000 lbs. per hour in accordance with engine speed and the temperature therein being in the range of 3,000° to 3,500°F, the temperature of said mass flow downstream of said exposed passage portions being lowered to the range of 600° to 725°F.

* * * * *